US007968784B2

(12) United States Patent
Yamada et al.

(10) Patent No.: US 7,968,784 B2
(45) Date of Patent: Jun. 28, 2011

(54) PERFORMANCE DEVICE SYSTEMS AND METHODS

(75) Inventors: Yasuyuki Yamada, Hamamatsu (JP); Hiroya Kurio, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 190 days.

(21) Appl. No.: 12/399,567

(22) Filed: Mar. 6, 2009

(65) Prior Publication Data

US 2009/0229449 A1 Sep. 17, 2009

(30) Foreign Application Priority Data

Mar. 11, 2008 (JP) ..... 2008-060718

(51) Int. Cl.
*G10H 1/40* (2006.01)

(52) U.S. Cl. ..... 84/612; 84/609; 84/615; 84/636; 84/652; 84/653; 84/668

(58) Field of Classification Search ..... None
See application file for complete search history.

(56) References Cited

U.S. PATENT DOCUMENTS

| | | | | |
|---|---|---|---|---|
| 6,535,772 | B1 * | 3/2003 | Miyamori et al. | 700/90 |
| 6,822,152 | B2 * | 11/2004 | Yamada et al. | 84/484 |
| 7,105,735 | B2 * | 9/2006 | Senoo et al. | 84/612 |
| 2004/0200336 | A1 * | 10/2004 | Senoo et al. | 84/612 |
| 2008/0034948 | A1 * | 2/2008 | Sumita | 84/636 |
| 2008/0295672 | A1 * | 12/2008 | Compton | 84/605 |
| 2009/0114081 | A1 * | 5/2009 | Kobayashi | 84/612 |
| 2009/0229448 | A1 * | 9/2009 | Yamada et al. | 84/612 |

FOREIGN PATENT DOCUMENTS

| | | |
|---|---|---|
| JP | 2003-150158 | 5/2003 |
| JP | 2006-145721 | 6/2006 |

* cited by examiner

*Primary Examiner* — Marlon T Fletcher
(74) *Attorney, Agent, or Firm* — Foley & Lardner LLP

(57) ABSTRACT

A timer may be for timing a current time period corresponding to an amount of time since a previous operation of an operator. Circuitry may be for processing data to carry out a performance based on a set tempo. The circuitry may be configured to change a position of the performance to a specified position of the performance in a case where the operator is operated and the current time period equals or exceeds a specified time period. The circuitry may be configured to change the tempo based on the current time period in a case where the operator is operated and the current time period is less than the specified time period.

26 Claims, 8 Drawing Sheets

PERFORMANCE DEVICE SYSTEMS AND METHODS

CROSS-REFERENCE TO RELATED PATENT APPLICATIONS

Japan Priority Application 2008-060718, filed Mar. 11, 2008 including the specification, drawings, claims and abstract, is incorporated herein by reference in its entirety.

BACKGROUND OF THE INVENTION

1. Field of the Invention

Embodiments of the present invention generally relate to performance device systems and methods and, in specific embodiments, to performance device systems and methods for changing a tempo and a performance position of a performance.

2. Related Art

Devices for setting a performance tempo in automatic performance devices, which carry out performance data stored in a time sequence that generates a musical performance and is read out sequentially, or in waveform reproduction devices, which stores, reads out, and reproduces the waveform of a performed musical tone, or the like, have been widely used among musical instrument players. These devices utilize a tap operation for setting the performance tempo based on a time interval that a switch has been tapped.

Japanese Unexamined Patent Application (Kokai) Publication Number 2003-150158 discloses a performance device for setting a delay time, which is a parameter of the delay effect comprising of a BPM (beats per minute i.e., a value for the speed of a performance) or a note length (e.g., a quarter note, an eighth note, etc.), as well as a time value. Furthermore, some performance devices used with electric guitars and the like are configured to be placed on the floor and to apply an effect to a musical tone signal output from the electric guitar. A pedal switch of the performance device may be operated to set the performance tempo according to the timing the pedal switch is tapped or otherwise operated. Such a performance device allows a user to set the performance tempo, but does not allow the user to correct the performance position. For example, the user would not be able to make the first (down) beat of the performance position coincide with the first beat of another performance (e.g., backing music).

Japanese Unexamined Patent Application (Kokai) Publication Number 200-145721 (Patent Reference 2) discloses a device for setting a performance tempo with a tap operation to change the performance position to the segmented position of the beat by the timing a switch of the device is set to On. As such, the performance position is adjusted each time the tap operation is carried out, resulting in the performance being stopped or stepped forward to produce an awkward performance. This can produce an unnatural performance feeling.

SUMMARY OF THE DISCLOSURE

A performance device may include, but is not limited to, an operator, a time calculation means, a tempo setting means, a storage means, a performance means, a performance position changing means, and a tempo changing means. The operator may be adapted to be operated by a performer. The time calculation means may be for calculating a time period between a timing where the operator is operated and a previous timing where the operator was previously operated. The tempo setting means may be for setting a performance tempo. The storage means may be for storing performance data.

The performance means may be for reading the performance data stored on the storage means to carry out a performance based on the performance tempo set by the tempo setting means. The performance position changing means may be for changing a performance position of the performance carried out by the performance means to a specified performance position in a case where the operator is operated and the time period calculated by the time calculation means equals or exceeds a specified time period. The tempo changing means may be for changing the performance tempo based on the time period calculated by the time calculation means in a case where the operator is operated and the time period calculated by the calculation means is less than the specified time period.

Thus, according to some embodiments, the performance position may be changed in a case where the operator is operated in a state in which the operator has not been operated for a specified amount of time or more. Meanwhile, the tempo may be set in a case where the operator is operated at a time interval shorter than the specified amount of time based on the time interval. As a result, a change in the performance position and the performance tempo may be operated using the same single operator. In addition, in such embodiments, because the performance position may change on the initial operation only and not change on subsequent operations, natural performances may be able to be carried out without stopping or stepping forward the performance.

In various embodiments, the performance data stored on the storage means may have a specified length. The performance means may be configured to carry out the performance by repeatedly reading the performance data stored on the storage means. The performance position changing means may be configured to change the performance position to a beginning point of the performance data. Thus in some embodiments, in a case where the performance has been repeated, the operator needs only to be operated once at the timing where the performance data should be started from the beginning. Accordingly, a user can easily set the performance to start from the beginning of a performance at the desired timing with a single operation of the operator.

In various embodiments, the performance device may further include a tempo fluctuation suppression means that may be for suppressing a fluctuation of the performance tempo. Thus in some embodiments, the performance tempo may be changed based on an average tempo or the like to avoid an accidental and/or large change in tempo.

In various embodiments, the performance device may further include a display means that may be for displaying an indicator for indicating that a tap input standby state is set. The performance position changing means may be configured to change the performance position of the performance performed by the performing means to the specified performance position in a case where the indicator indicates that the tap input standby state is set and the operator is operated in the tap input standby state. Thus in some embodiments, in a case where a user desires to change the performance position, the user may be able to confirm visually that the tap input standby state is set using the display means. As a result, the user may be able to change the performance position with certainty.

A performance device for adjusting a musical performance may include, but is not limited to, an operator, a timer, a control, and circuitry. The operator may be adapted to be operated by a user. The timer may be for timing a current time period corresponding to an amount of time since a previous operation of the operator. The control may be for setting a tempo.

The circuitry may be for processing data to carry out a performance based on the tempo. The circuitry may be configured to change a position of the performance to a specified position of the performance in a case where the operator is operated and the current time period equals or exceeds a specified time period. The circuitry may be configured to change the tempo based on the current time period in a case where the operator is operated and the current time period is less than the specified time period.

In various embodiments, the performance device may further include a storage device that may be for storing the data processed by the circuitry. In various embodiments, the data may comprise performance information. The circuitry may be configured to process the performance information repeatedly.

In various embodiments, the data may comprise performance information. The circuitry may be configured to change a position of the performance to a beginning position of the performance information in a case where the operator is operated and the current time period equals or exceeds a specified time period.

In various embodiments, the circuitry may be configured to set a first state in a case where the operator is operated and the current time period equals or exceeds a specified time period. The circuitry may be configured to set a second state in a case where the operator is operated and the current time period is less than the specified time period. In some embodiments, the performance device may further include a display device that may be for indicating that at least one of the first state and the second state is set. In some embodiments, the circuitry may be configured to change a position of the performance to a specified position of the performance in a case where (i) the operator is operated, (ii) the display device indicates that the first state is set, and (iii) the operator is operated in the first state.

In various embodiments, the circuitry may be configured to change the tempo based on the current time period in a case where the current time period is less than the specified time period and a time period of a subsequent operation of the operator is within a specified range of the current time period. In some embodiments, the specified range may be approximately between two-thirds of the current time period and three-halves of the current time period. In some embodiments, the tempo may be set based on an average of the current time period and the time periods of the subsequent operation.

A method of adjusting a musical performance may include, but is not limited to anyone or combination of, (i) calculating a current time period between a timing where an operator is operated and a previous timing where the operator was previously operated; (ii) setting a tempo; (iii) carrying out a performance based on the tempo; (iv) changing a position of the performance to a specified position of the performance in a case where the operator is operated and the current time period equals or exceeds a specified time period; and (v) changing the tempo based on the current time period in a case where the operator is operated and the current time period is less than the specified time period.

DETAILED DESCRIPTION OF EMBODIMENTS OF THE PRESENT INVENTION

Figure 1:
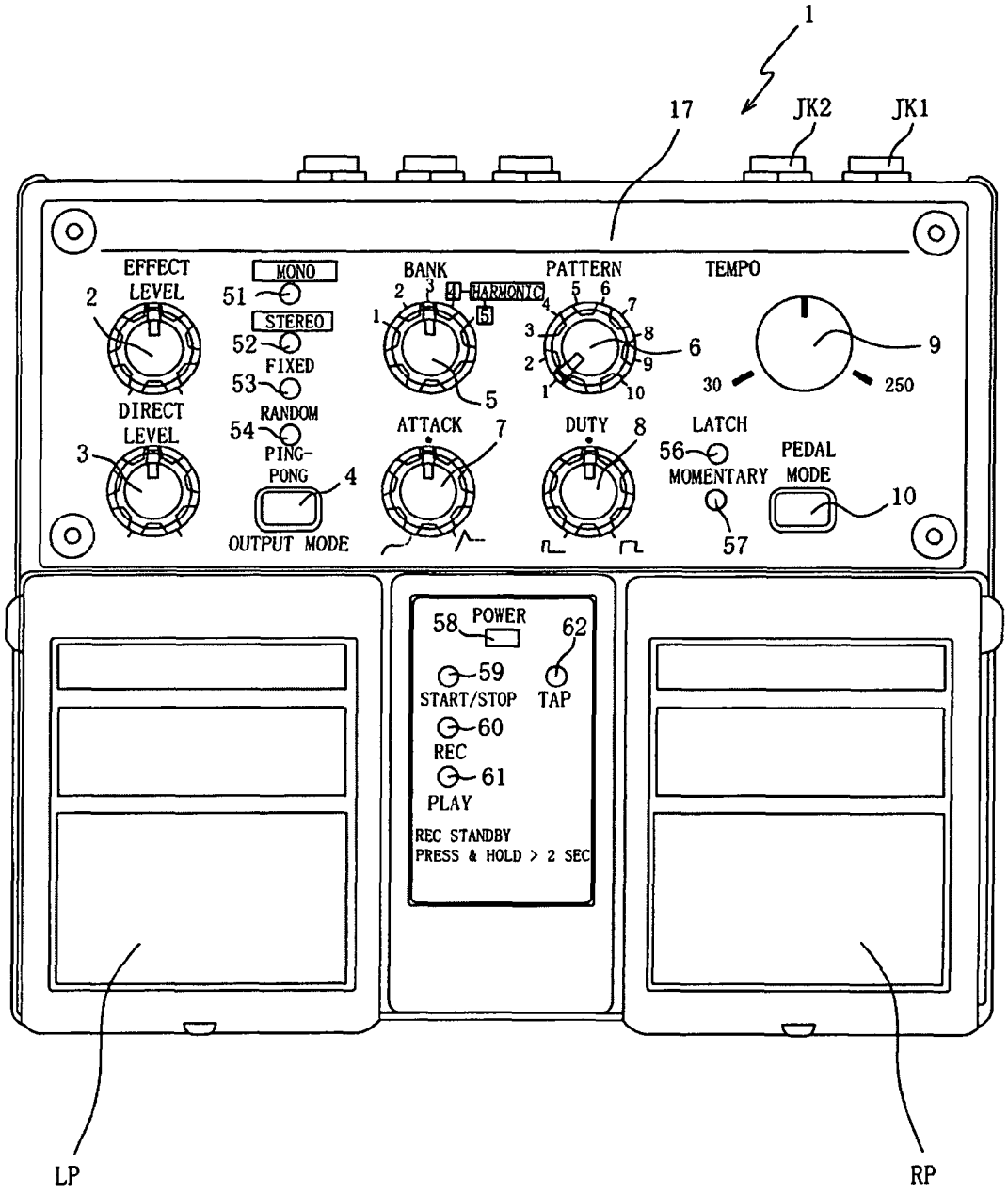
FIG. 1 is a front view of an effect device in accordance with an embodiment of the present invention.

FIG. 1 is a front view of an effect device 1 in accordance with an embodiment of the present invention. The effect device 1 may be for applying an effect to a musical tone signal outputted by a musical instrument, such as (but not limited to) a stringed instrument like a guitar, or the like. In some embodiments, the effect device 1 may be configured to combine a first signal inputted from a musical instrument and a second signal, which resulted from an effect being applied to the first signal. When using the device, for example, during a musical performance, the effect device 1 may be set on the floor and a user may operate the effect device 1, for example, with his or her foot, while performing on a musical instrument.

The effect device 1 may have a plurality of operators or controls disposed on an operating panel 17 of the effect device 1. The operating panel 17 may be for setting various kinds of parameters prior to and during use of the effect device 1. The operating panel 17 of the effect device 1 may include a plurality of controls, such as knobs, switches, dials, and the like. For example, the embodiment shown in FIG. 1 includes an effect level knob 2, a direct level knob 3, a bank knob 5, a pattern knob 6, an attack knob 7, a duty knob 8, and a tempo knob 9. However, as previously discussed, the effect device 1 may include any suitable types of controls for setting parameters in addition to or in place of the knobs.

The effect level knob 2 may be for adjusting an effect level, which may be an output level of a musical tone having an applied effect. The direct level knob 3 may be for adjusting a direct level, which may be an output of an inputted musical tone that has not had an effect applied.

The bank knob 5 may be for selecting a bank, where, for example, ten performance patterns may be set in advance to each bank. The pattern knob 6 may be for selecting one of the performance patterns. The performance pattern may be, for example, one bar or two bars of performance data. The performance pattern may include information regarding timing for turning on (or off) an output of a filter associated with a string of a guitar, for example. Details of the performance pattern will discussed later while referring to FIG. 5.

Referring back to FIG. 1, the attack knob 7 may be for adjusting a waveform of an attack portion. The attack portion may be an initial rise at a time that a filtered musical tone is outputted. For example, when the attack knob 7 is turned to one end, the initial rise may have a gradual slope, while when the attack knob 7 is turned to an opposite end, the initial rise may have a steep slope.

The duty knob 8 may be for adjusting a period of time that the filtered musical tone is outputted. For example, when the duty knob 8 is turned to one end, the period may be short, while when the duty knob 8 is turned to an opposite end the period may be longer.

The tempo knob 9 may be for adjusting a performance tempo. For example, when the tempo knob 9 is turned to one end, the performance tempo may become slower; while when the tempo knob 9 is turned to an opposite end, the performance tempo may become quicker. In some embodiments, the performance tempo may be displayed. A beat count of the performance tempo may be calculated in intervals, such as one-minute intervals, and may have values that can be selected by the user. For example (but not limited to), between 30 and 250. A value may be selected by the user using the tempo knob 9 and/or one or more other controls (e.g., right pedal switch RP). The value may be set to a value that was last used (i.e., last in priority). The value of the performance tempo may indicate a speed of a musical performance and may be expressed using a beat count calculated for a one-minute interval (e.g., BPM: beats per minute).

The effect device 1 may further include, but is not limited to, an output mode switch 4, a pedal mode switch 10, a left pedal switch LP, and a right pedal switch RP. The output mode switch 4 may be for setting an output mode, for example monaural mode, stereo mode, or the like. The stereo mode may further include a fixed mode (e.g., fixed acoustic image of the stereo position), a random mode (e.g., acoustic image of the stereo position shifts randomly between the left and right channels), a "ping-pong" mode (e.g., acoustic image of the stereo position shifts intermittently between the left and right channels), or the like. The effect device 1 may include a display, such as LEDs 51-54, corresponding to the output modes, respectively. For example, when the output mode switch 4 is operated (e.g., pressed down), an LED corresponding to the selected mode may be lit. Another output mode may be selected by further operating the output mode switch 4.

The pedal mode switch 10 may be for toggling a pedal mode. For example, the pedal mode can be toggled between a latch mode and a momentary mode, where the pedal modes may be alternately selected each time the pedal mode switch is operated (e.g., pressed down). The effect device 1 may include a display, such as LEDs 56 and 57, corresponding to the pedal modes, respectively. For example, when the pedal mode switch 10 is operated (e.g., pressed down), an LED corresponding to the selected mode may be lit. A new pedal mode may be selected by further operating the pedal mode switch 10.

The effect produced because of toggling the pedal mode switch 10 may be toggled on and off by operating another control, such as the left pedal switch LP. For example, in a case where the momentary mode has been selected, the LED 57 may be lit. Accordingly, an effect may be applied to an inputted musical tone while the left pedal switch LP is being operated (e.g., pressed down), and the effect may be stopped (being applied) when the left pedal switch LP is no longer being operated (e.g., not pressed down).

The left pedal switch LP and the right pedal switch RP may be, respectively arranged on a left side and a right side of a lower portion of the operating panel 17, or any other suitable location. The effect device 1 may include a display, for example LEDs 58-62, for indicating various information. The LEDs 58-62 may be disposed, for example, between the left pedal switch LP and the right pedal switch RP. In some embodiments, the effect device 1 may include a power LED 58, an LED 59 for indicating start or stop of the effect or the recording and playback, an LED 60 indicating a recording state, an LED 61 indicating a playback state, and a tap LED 62.

The power LED 58 may be lit in a case where power to the effect device 1 is being supplied by a power supply (not shown). The power supply (not shown) may be a battery, or the like, or an external AC adapter, or the like. In a case where the power supply (not shown) is a battery, the power may be turned on by performing an action, for example, operating a power button (not shown), or by inserting a plug into an input jack, or the like. Meanwhile the power may be cut off when the power button (not shown) is further operated or the plug is pulled out from the input jack, or the like. In a case where the power supply (not shown) is an AC adapter, the power may be turned on when a connector of the AC adapter is inserted, or the power button (not shown) is thereafter operated. If a battery is in the device, the power supplied from the battery may be turned off to conserve the battery, when power is supplied by the AC adapter.

The left pedal switch LP may have a latch mode and a momentary mode, as previously discussed. In the latch mode, a recording mode may be set by operating the left pedal switch LP for a period of time, for example, by pressing down the left pedal switch LP for two seconds or more. In the recording mode, a recording standby state may be initially set and the LED 60 may indicate this by flashing, for example. When the left pedal switch LP is further operated recording may begin, thus becoming the recording state, and may be indicated accordingly on the LED 60, by switching from a flashing state to a lit state, for example. While in the recording state, a musical tone having an applied effect may be stored in memory (e.g., RAM 12 in FIG. 2).

When the left pedal switch LP is yet further operated, the recording may end. Accordingly, a reproduction (i.e., playback) of the recorded musical tone may be played. At this time, the LED 60 may be turned off and the LED 61 may be turned on and lit. During playback of the recorded musical tone, a portion of the recorded musical tone may be trimmed with a suitable repeat point on a beat that may be repeatedly reproduced and played back. During playback of the recorded musical tone, a speed at which the reproduction is played may be changed by changing the value of the performance tempo (e.g., with tempo knob 9).

The right pedal switch RP may have multiple functions. For example, the right pedal switch RP may be for setting the performance tempo (in addition to or in alternative to tempo knob 9). In a case where the right pedal switch RP has not been operated for a specified period of time (or longer), a tap input standby state may be set, and the tap LED 62 may be turned off. In a case where the right pedal switch RP is operated On in the tap input standby state, a position of the performance pattern may be reset to the beginning of the performance pattern.

Thus, when the right pedal switch RP is operated On in the tap input standby state, the position of the performance pattern may be reset to the beginning of the performance pattern. Accordingly, it may be possible to synchronize an uncoordinated musical performance performed by the user (or band) and the performance pattern outputted by the effect device 1. For example, the effect device 1 may be configured to match a timing of a rhythm of the performance pattern outputted by the effect device 1 to a timing of a rhythm of the musical performance of the user.

As discussed, in a case where the right pedal switch RP has not been operated for a specified period of time (or more), the tap input standby state may be set and the tap LED 62 may be turned off. Meanwhile, the tap LED 62 may be turned on in a case where the tap input standby state is not set. Accordingly, the performance tempo may be set based on the time interval in which the right pedal switch RP has been operated On. Accordingly, it may be possible for the user to ascertain whether or not the tap input standby state is set by looking at the tap LED 62. Thus, if the user desires to reset and change the position of the performance pattern to the beginning (i.e., a start point) of the performance pattern, the user may operate the right pedal switch RP while in the tap input standby state (e.g., the tap LED 62 is off). Accordingly, the effect device 1 may be configured to perform two different settings (the timing setting and the performance tempo setting) by use of the right pedal switch RP.

Figure 2:
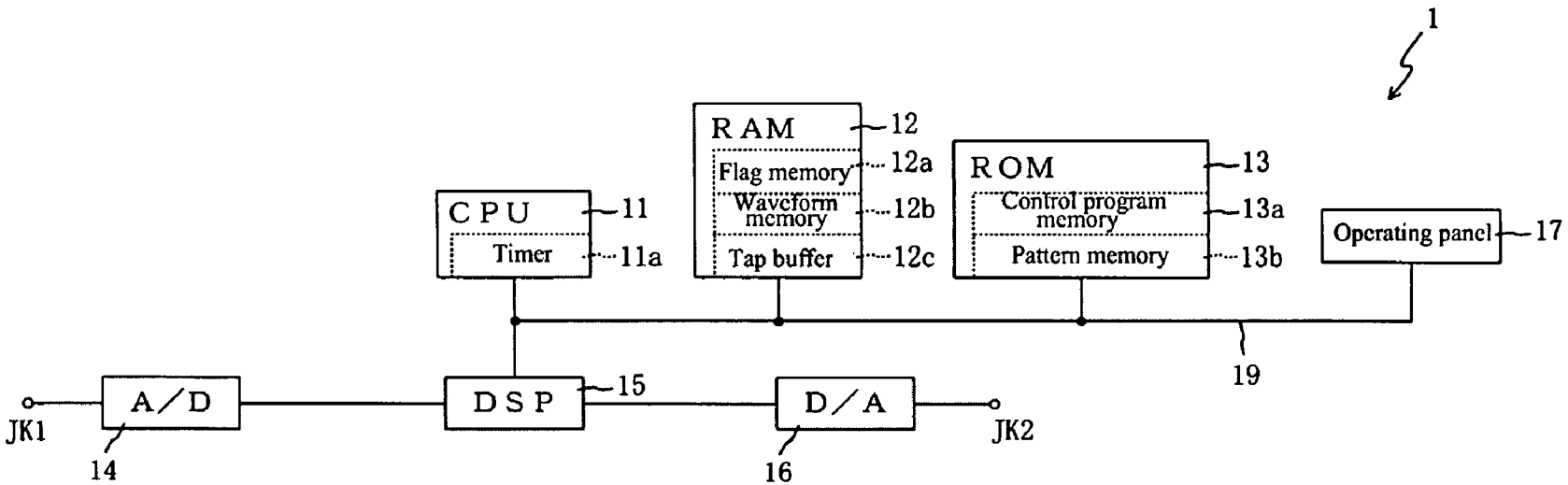
FIG. 2 is a block diagram illustrating an electrical configuration of an effect device in accordance with an embodiment of the present invention.

FIG. 2 is a block diagram illustrating an electrical configuration of an effect device 1 in accordance with an embodiment of the present invention. The effect device 1 may include, but is not limited to, a CPU 11, RAM (random access memory) 12, ROM (read only memory) 13, an A/D (analog-digital) converter 14, a DSP (digital signal processor) 15, a D/A (digital-analog) converter 16, and the operating panel 17, as previously described.

The CPU 11, the RAM 12, the ROM 13, the DSP 15, and the operating panel 17 may be mutually connected via bus 19. The CPU 11 may be configured to detect operations of the controls, such as those previously discussed, on the operating panel 17. The CPU 11 may be further configured to apply effects to inputted musical tones in conformance with a detected state, or the like. The CPU 11 may include a timer 11*a* for calculating a time interval or period of how long the right pedal switch RP (refer to FIG. 1) has been operated On, and may accordingly set the performance tempo based on the time interval. The CPU 11 may further include a timer interrupt that may be configured to execute an interrupt processing at a time interval corresponding to the set performance tempo.

The RAM 12 may be rewritable memory that can be accessed randomly. The RAM 12 may for temporarily storing variables when the CPU 11 executes control programs stored in the ROM 13. The RAM 12 may include, but is not limited to, flag memory 12*a* for storing various types of flags, waveform memory 12*b* for storing a recorded musical tone, and a tap buffer 12*c* for storing a time interval calculated by the timer 11*a*, for example, in a case where a tap operation is performed.

A tap flag, a recording flag, and an effect flag may be stored in the flag memory 12*a*. The tap flag may be set to 0 in a case where the tap input standby state is set. The tap flag may be set to 1 when the right pedal switch RP (FIG. 1) is operated On (from an Off state) while in the tap input standby state to set the position of the performance pattern to the beginning of the performance pattern. In a case where the tap flag is 1 and the tap input standby state is not set, a performance tempo may be set based on the interval in which the right pedal switch RP (FIG. 1) was operated On. For example, in a case where a time interval or period when the right pedal switch RP (FIG. 1) has been switched On exceeds a specified time, for example 2.5 seconds, or more, the tap flag may be set to 0 and the tap input standby state may be set. The tap LED 62 (FIG. 1) may indicate whether the tap flag is 0 or 1. For example, the tap LED 62 (FIG. 1) may be Off when the tap flag is 0 and may be lit when the tap flag is 1.

The recording flag may indicate the recording state or the playback state and may be set to 1 in those cases where the left pedal switch LP (FIG. 1) is operated and the recording mode has started. When the recording is stopped, the playback of the recorded musical tone may begin. When the playback has stopped, the recording mode may be at an end, and the recording flag may be set to 0.

The effect flag may be set to 1 in a case where an effect is applied, and may be set to 0 in a case where the effect is not applied (or has stopped being applied). The LED 59 (FIG. 1) may indicate whether the effect flag is 0 or 1. For example, the LED 59 (FIG. 1) may be lit when the effect flag is 1 and off when the effect flag is 0.

As discussed above, the tap buffer 12*c* may be for storing the time intervals calculated by the timer 11*a* when a tap operation on the right pedal switch RP (FIG. 1) is performed. For instance, time intervals measured from a previous operation on the right pedal switch RP (FIG. 1) to a second operation may be calculated by the timer 11*a* corresponding to how long the right pedal switch RP (FIG. 1) have been operated On and then may be stored in the tap buffer 12*c*. Subsequent time intervals may be calculated and stored in a similar manner.

In a case where the user desires to change a performance tempo of a slice effect or a timing of a beat, the right pedal switch RP (FIG. 1) may be operated and the position of the performance pattern and the performance tempo may be adjusted accordingly. In a case where an initial operation is performed in the tap input standby state, the position of the performance pattern may be set to the beginning of the performance pattern. Next, time intervals calculated from the previous operation to the second and subsequent operations may be calculated, and may be then stored in succession in the tap buffer 12*c*. Then, an average value of the stored time intervals may be computed, and the performance tempo may be changed based on the average value.

A pointer may indicate a storage address for storing the calculated time interval in the tap buffer 12*c*. The calculated time interval may be stored at the storage address to which the pointer indicates. Accordingly, the pointer may be advanced by 1, for example, to the next storage address. A plurality of intervals may be stored. For example, in particular embodiments, the tap buffer 12*c* may have eight storage addresses for storing eight time intervals. In a case where more than eight time intervals are calculated, an oldest time interval may be deleted, which may allow the newest time interval to be stored.

The A/D converter 14 may be configured to convert an analog signal into a digital signal. An output signal of a musical instrument, such as an electric guitar, or the like may be an analog signal and may be connected to a jack JK1, which may be in communication with the A/D converter 14. The A/D converter 14 may be configured to sample the analog signal at a specified sampling frequency (e.g., 48 kHz), and may be further configured to quantize the sampled signal at a specified bit count (e.g., 16 bits), and may be yet further configured to output the quantized sampled signal to the DSP 15.

The DSP 15 may be configured to apply an effect, such as a slice effect, to a quantized sampled signal of the inputted musical tone. The DSP 15 may be configured to convert the musical tone into an analog signal with the D/A converter 16. The analog signal may be then outputted from a jack JK2. An amplifier (not shown), or the like, may be connected to the jack JK2, which may allow for sound to be emitted from a speaker (not shown), or the like, driven by the amplifier (not shown).

Figure 3:
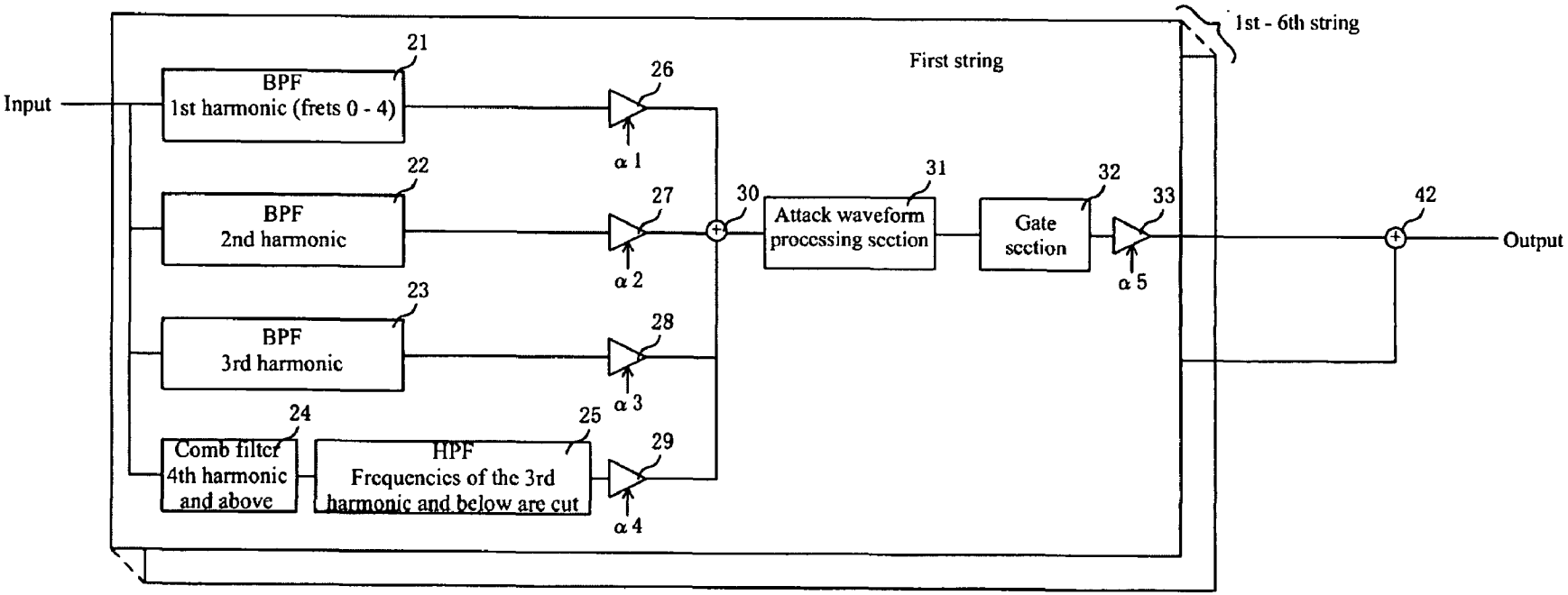
FIG. 3 is a block diagram illustrating functions of a digital signal processor (DSP) in accordance with an embodiment of the present invention.

FIG. 3 is a block diagram illustrating functions of a digital signal processor (DSP) in accordance with an embodiment of the present invention. The DSP 15 may be configured to perform various kinds of processes in accordance with a preset program. As demonstrated in FIG. 3, the DSP 15 may include six functional blocks corresponding to six strings of a guitar. However, a DSP having any number of functional blocks may be used, as well as an instrument with any number of operators, such as strings, may be used.

In FIG. 3, only a functional block corresponding to a first string of a guitar is shown and functional blocks for the second through sixth strings have been omitted. The omitted functional blocks are the same as the functional block corresponding to the first string. In some embodiments, parameter values of the functional blocks may be different.

Signals input from a musical instrument, such as an electric guitar, or the like, are supplied in common to each of the function blocks corresponding to their respective string. The following explanation explains the functional block corresponding to the first string. The functional block may include, but is not limited to, bandpass filters 21, 22, and 23, a comb filter 24, a highpass filter 25, multipliers 26-29, an adder 30, an attack waveform processing section 31, a gate section 32, and a multiplier 33.

The bandpass filter 21 may be configured to pass musical tones of certain pitches, for example, up to four frets from an open string of the first string of the guitar. In some embodiments, the bandpass filter 21 may have characteristics for passing musical tones having frequencies within a frequency band, for example, from 330 Hz to 420 Hz. Accordingly, musical tones having frequencies outside the frequency band may be attenuated (e.g., not passed).

The bandpass filter 22 may be configured to pass musical tones having frequencies within a frequency band that are double the frequency band passed by the bandpass filter 21. In some embodiments, musical tones having frequencies within a frequency band, for example, from 660 Hz to 840 Hz may be passed. The bandpass filter 23 may be configured to pass musical tones having frequencies within a frequency band that are triple the frequency band passed by the bandpass filter 21. In some embodiments, musical tones having frequencies within a frequency band, for example, from 990 Hz to 1,260 Hz may be passed.

The comb filter 24 may be configured to have a base point, which may correspond to a frequency of the second fret, for example 370 Hz. The comb filter 24 may be configured to pass musical tones having an integral multiple of the base point. The highpass filter 25 may be configured to pass musical tones with frequencies within a frequency band, for example, of 1,260 Hz and above.

The multipliers 26-29 may be for multiplying coefficients $\alpha$1-$\alpha$4, respectively, for setting levels to respective outputs of the bandpass filters 21 through 23 and the highpass filter 25. The coefficients $\alpha$1-$\alpha$4 may be values set in advance (e.g., stored during manufacture). Values of the coefficients $\alpha$1-$\alpha$4 may change in conformance with a mode of the performance pattern. Values of the coefficients $\alpha$1-$\alpha$4 may be different at each timing to be performed. In some embodiments, a timbre with stressed harmonics may be produced when the coefficients $\alpha$2-$\alpha$4 have values larger than a value of the coefficient $\alpha$1.

The adder 30 may be configured to combine each of the musical tone signals that have been multiplied by the coefficients $\alpha$1-$\alpha$4 by the multipliers 26-29. The adder 30 may be further configured to output the combined musical tone signal to the attack waveform processing section 31. The attack waveform processing section 31 may be configured to apply a form of the initial rise of the musical tone set with the attack knob 7 (FIG. 1) to the musical tone outputted by the adder 30. The attack wave processing section 31 may be further configured to output the formed musical tone to the gate section 32.

The gate section 32 may be configured to toggle on and off the output of the waveform formed from the attack waveform by the attack waveform processing section 31. The output may be set to "on" in a case where an output instruction has been executed by the CPU 11 (FIG. 2). The period of time for which the process is on may be set by the duty knob 8 (FIG. 1). The formed musical tone output from the gate section 32 may be multiplied by coefficient $\alpha$5 by the multiplier 33 and may be outputted to the adder 42. Each output of the multiplier 33 for each of the functional blocks corresponding to the first through sixth strings may be combined by the adder 42 and may be outputted to the D/A converter 16.

Although not shown in FIG. 3, in some embodiments, the DSP 15 may include a bypass circuit for directly outputting the input signal (e.g., the musical tone signal inputted from a guitar). In a case where an instruction has been issued, for example, when the left pedal switch LP (FIG. 1) is operated and an effect is started, the bypass circuit may be bypassed and, accordingly, a musical tone having an applied effect may be outputted. Whereas in a case where an instruction has been issued, for example, to stop the effect, the bypass circuit may cut off the output of the adder 42 and directly output the input signal, thus bypassing the effect circuit.

Figure 4:
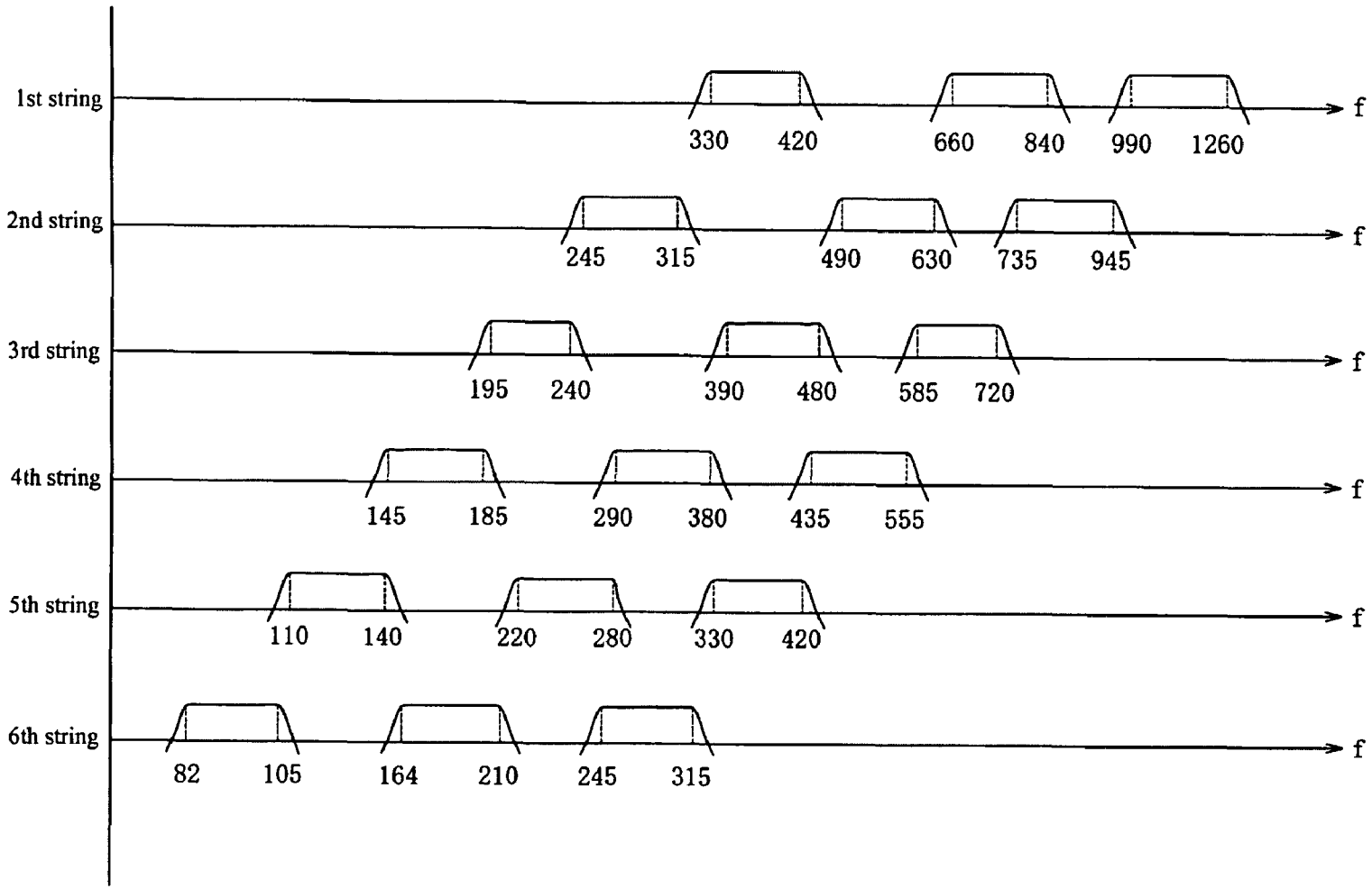
FIG. 4 illustrates frequency characteristics of each bandpass filter in accordance with an embodiment of the present invention.

FIG. 4 illustrates frequency characteristics of bandpass filters 21-23 (FIG. 3) for each of a plurality of strings of a guitar in accordance with an embodiment of the present invention. The horizontal axis may represent frequency (logarithmically) and the vertical axis may represent a signal level passed by each respective filter for each of the strings. With reference to FIGS. 3 and 4, the frequency bands for the bandpass filters 21-23 may be configured so that it may be possible to identify the strings of the musical instrument that have been performed or otherwise operated through a frequency of an inputted music tone.

For example, for the bandpass filters corresponding to the sixth string, the frequency band of the bandpass filter 21 may be set to, for example, approximately 82 to 105 Hz, which may be in conformance with a fundamental tone (or first harmonic). This is because a frequency of an open sixth string (e.g., no fret is pressed) may be 82.4 Hz and a frequency for the fourth fret (i.e., fourth fret is pressed) may be 103.8 Hz. Thus, under such a configuration, musical tones for the sixth string from the open through the fourth fret may be passed by the bandpass filter 21.

Similarly, for the bandpass filters corresponding to the fifth string, the frequency band of the bandpass filter 21 may be set to, for example, approximately 110 to 140 Hz, which may be in conformance with a fundamental tone (or first harmonic). This is because a frequency of an open fifth string may be 110 Hz and a frequency for the fourth fret may be 138.6 Hz. Thus, under such a configuration, musical tones for the fifth string from the open through the fourth fret may be passed by the bandpass filter 21.

In addition, the bandpass filter 22 corresponding to the second harmonic and the bandpass filter 23 corresponding to the third harmonic may be configured for each string. For example, for the sixth string, the bandpass filter 22 may be set to, for example, approximately 164 through 210 Hz, which may be the frequency band of the second harmonic of the fundamental tone; and the bandpass filter 23 may be set to, for example, approximately 245 through 315 Hz, which may be the frequency band of the third harmonic of the fundamental tone.

The bands for the fundamental tone and the harmonics may be selected or otherwise established to prevent a loss of the timbre. Otherwise, the original timbre may be lost because the harmonics would be cut off if only the fundamental tone were passed by the filters. Incidentally, in some embodiments, the described frequency bands may be frequency bands corresponding to registers of zero through four frets (e.g., the sixth, fifth, fourth, second, and first strings) or zero through three frets (e.g., the third string) of a guitar.

In some embodiments, in a case where a slope of a filter characteristic at a cutoff frequency is gradual, the frequency band may be set narrower than a theoretical value, such as the theoretical values described above, which may allow for better separation of the tones of each of the strings. For example, the frequency band of the bandpass filter 21 corresponding to the fundamental tone of the sixth string may be set to, for example, 85 through 100 Hz, or the like. Conversely, in a case where a slope of a filter characteristic at a cutoff frequency is steep, the frequency band may be set broader than the theoretical value, which may allow for drawing out a sound having a timbre near that of the original sound while satisfactorily preserving separation of the tones of each string.

Figure 5A:
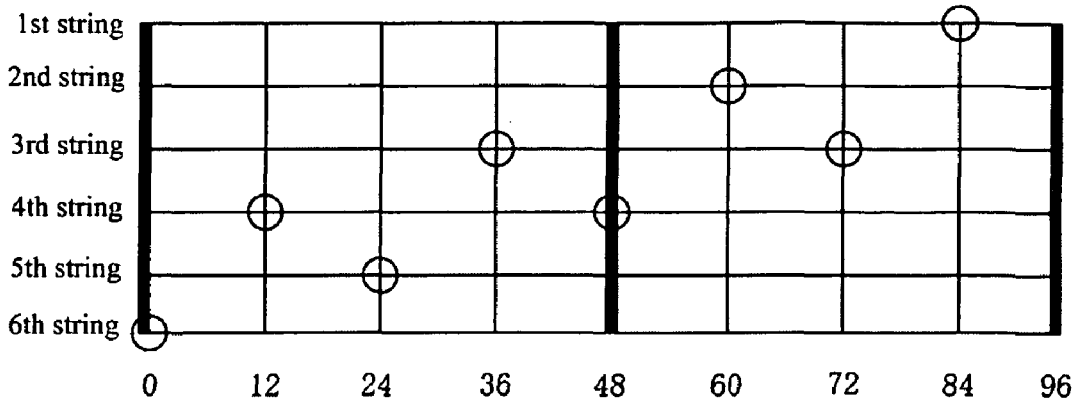
FIGS. 5(*a*) and 5(*b*) are schematic drawings illustrating a performance pattern in accordance with an embodiment of the present invention.
Figure 5B:
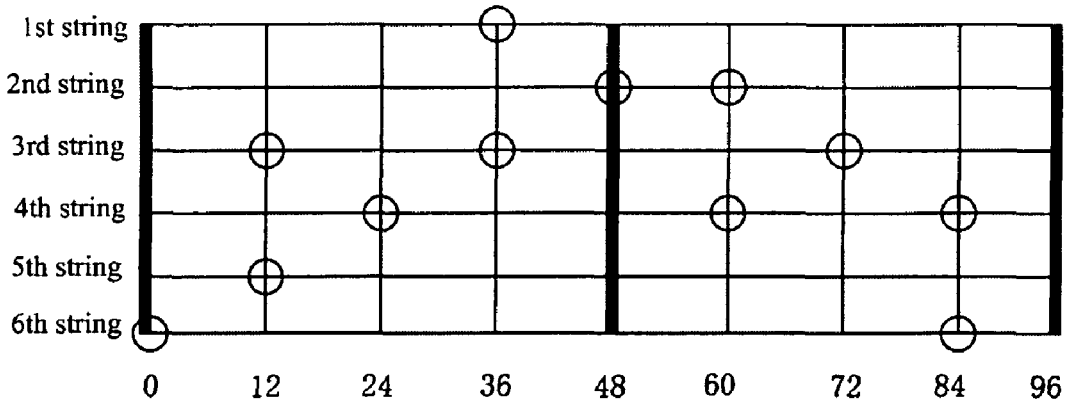

FIGS. 5(*a*) and 5(*b*) are schematic drawings illustrating performance patterns in accordance with an embodiment of the present invention. The horizontal axis may designate ticks and the vertical axis may designate string numbers. Positions at which the gate section 32 (FIG. 3) may be opened may be denoted by circles. The ticks may be units of time into which a single beat is subdivided. In other words, the tick may be a unit of time in which the beat has been divided by an integer.

As mentioned, the value of the performance tempo may be the number of beats calculated per minute. In the embodiments shown in FIGS. 5(*a*) and 5(*b*), the integer may be, for example, a 12 and there are eight beats. In other embodiments, any suitable integer may be chosen. In general, as a magnitude of the integer increases, time resolution may increase, which may allow for finer timing settings.

FIGS. 5(*a*) and 5(*b*) are each examples of a performance pattern in which a total of eight beats are repeatedly performed as one pattern. For example, in FIG. 5(*a*), at tick 0, the gate section 32 (FIG. 3) corresponding to the sixth string may be turned on for a specified period of time. The specified period of time that the gate section 32 (FIG. 3) is on may be set by the duty knob 8 (FIG. 1), as described above, and the form for the initial rise waveform may be set by the attack knob 7 (FIG. 1), as described above.

Next, the gate section 32 (FIG. 3) corresponding to the fourth string may be turned on at tick 12 and the gate section 32 (FIG. 3) corresponding to the third string may be turned on at tick 36. Similarly, the gate sections 32 (FIG. 3) corresponding to the other strings may be turned on at their respective ticks. The performance pattern of FIG. 5(*a*) may be configured such that only one gate section 32 (FIG. 3) is turned on per beat. While the performance pattern of FIG. 5(*b*) may be configured such that a plurality of gate sections 32 (FIG. 3) may be turned on at the same tick, for example at tick 12 and tick 36.

Performance or control information stored in the pattern memory 13*b* (FIG. 2) of the ROM 13 (FIG. 2) may correspond to the time expressed by the tick, and may correspond to one of the processing blocks for the first string through the sixth string that is to be outputted. In some embodiments, the performance information may include at least one of the attack waveform, the duty, and the coefficients $\alpha$1 through $\alpha$5.

Figure 6:
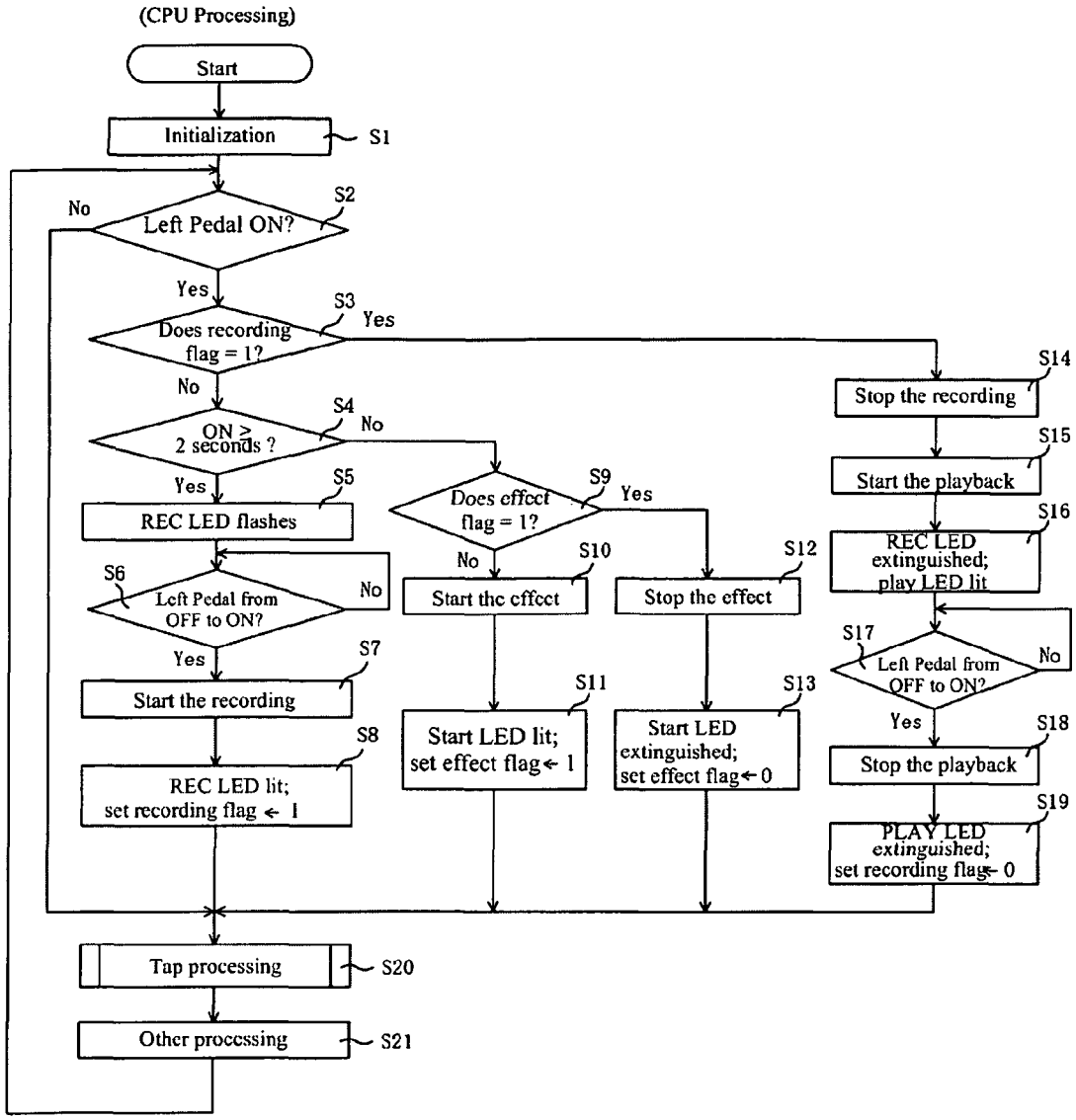
FIG. 6 is a flowchart illustrating main processing in accordance with an embodiment of the present invention.

FIG. 6 is a flowchart illustrating main processing that may be executed by the control program stored in the ROM 13 (FIG. 2) by CPU 11 (FIG. 2) in accordance with an embodiment of the present invention. Referring to FIGS. 1, 2, and 6, the main processing may be started when the power to the effect device 1 is turned on and may be repeatedly carried out until the power is turned off. In step S1, initialization of the main processing may occur. In the initialization, the recording flag, the effect flag, and the tap flag may be set to 0. In addition, a time interval for a tick may be derived from the value of the performance tempo set using the tempo knob 9. Accordingly, a timer interrupt may be generated at the time interval.

Next in step S2, a determination may be made as to whether or not the left pedal switch LP has been operated On. If the left pedal switch LP has been operated On (S2: yes), a determination may be made as to whether or not the recording flag is set to 1 (step S3). If the recording flag has not been set to 1 (S3: no), a determination may be made as to whether or not the left pedal switch LP has been operated (e.g., pressed down) continuously for a period of time, such as two seconds or more (step S4). The period of time the left pedal switch LP has been operated may be calculated by the timer 11*a*. If the left pedal switch LP has been operated continuously for two seconds or more (S4: yes), the LED 60 may begin to flash (step S5), which may allow the user to ascertain that the effect device 1 is in the recording standby state.

Next in step S6 (i.e., in the recording standby state), a determination may be made as to whether or not the left pedal switch LP has been (further) operated from Off to On. If the left pedal switch LP has been operated On (S6: yes), an instruction may be issued to the DSP 15 to start the recording processing to record the musical tone (step S7). In the recording processing, a musical tone signal having an applied effect by the DSP 15 may be outputted at a specified sampling frequency. Accordingly, the DSP 15 may write data to the RAM 12, for example, for storing the data in the waveform memory 12*b*. As such, in step S8, the LED 60 may be lit and the recording flag may be set to 1.

On the other hand, if during step S4, the left pedal switch LP has been On for less than two seconds (S4: no), a determination may be made as to whether or not the effect flag has been set to 1 (step S9). If the effect flag has not been set to 1 (S9: no), the effect may be started (step S10). Accordingly, in step S11, the start LED 59 may be lit and the effect flag may be set to 1. If the effect flag is set to 1 (S9: yes), the effect may be stopped (step S12). Accordingly, in step S13, the start LED 59 may be turned off and the effect flag may be set to 0.

In some embodiments, in a case where the effect is started, the time calculated by the timer 11*a*, which generates the timer interrupt, may be set to 0 and, accordingly, the DSP 15 bypass circuit may be bypassed. Meanwhile in a case where the effect is stopped, the bypass circuit may cause the output of the adder 42 (FIG. 3) to be bypassed such that the inputted musical tone signal is directly outputted.

If during step S3, the recording flag is set to 1 (S3: yes), an instruction may be issued to the DSP 15 to stop the recording of the musical tone (step S14). Next, in step S15, an instruction may be issued to the DSP 15 to start playback of the recorded musical tone. Accordingly, in step S16, the LED 60 may be turned off and the LED 61 may be lit.

Next in step S17 (i.e., during the playback of the recorded musical tone), a determination as to whether or not the left pedal switch LP is operated from Off to On may be made. If the left pedal switch LP has been operated from Off to On (S17: yes), an instruction may be issued to the DSP 15 to stop the playback (step S18). Accordingly, in step S19, the LED 61 may be turned off and the recording flag may be set to 0. Playback may continue if the left pedal switch LP is not operated from Off to On (S17: no).

If during step S2, the left pedal switch LP is not operated On (S2: no), or in those cases where any of steps S8, S11, S13, and S19 has been performed, tap processing may be carried out (step S20), which will be described later with respect to FIG. 7. Referring back to FIGS. 1, 2, and 6, next in step S21

(i.e., upon completion of the tap processing of step S20), other processing may be carried out (step S21), and the routine may return to the processing of step S2. In the other processing of step S21, a state for each of the operators on the operating panel 17 may be detected and processing may be performed based on the detected states.

Figure 7:
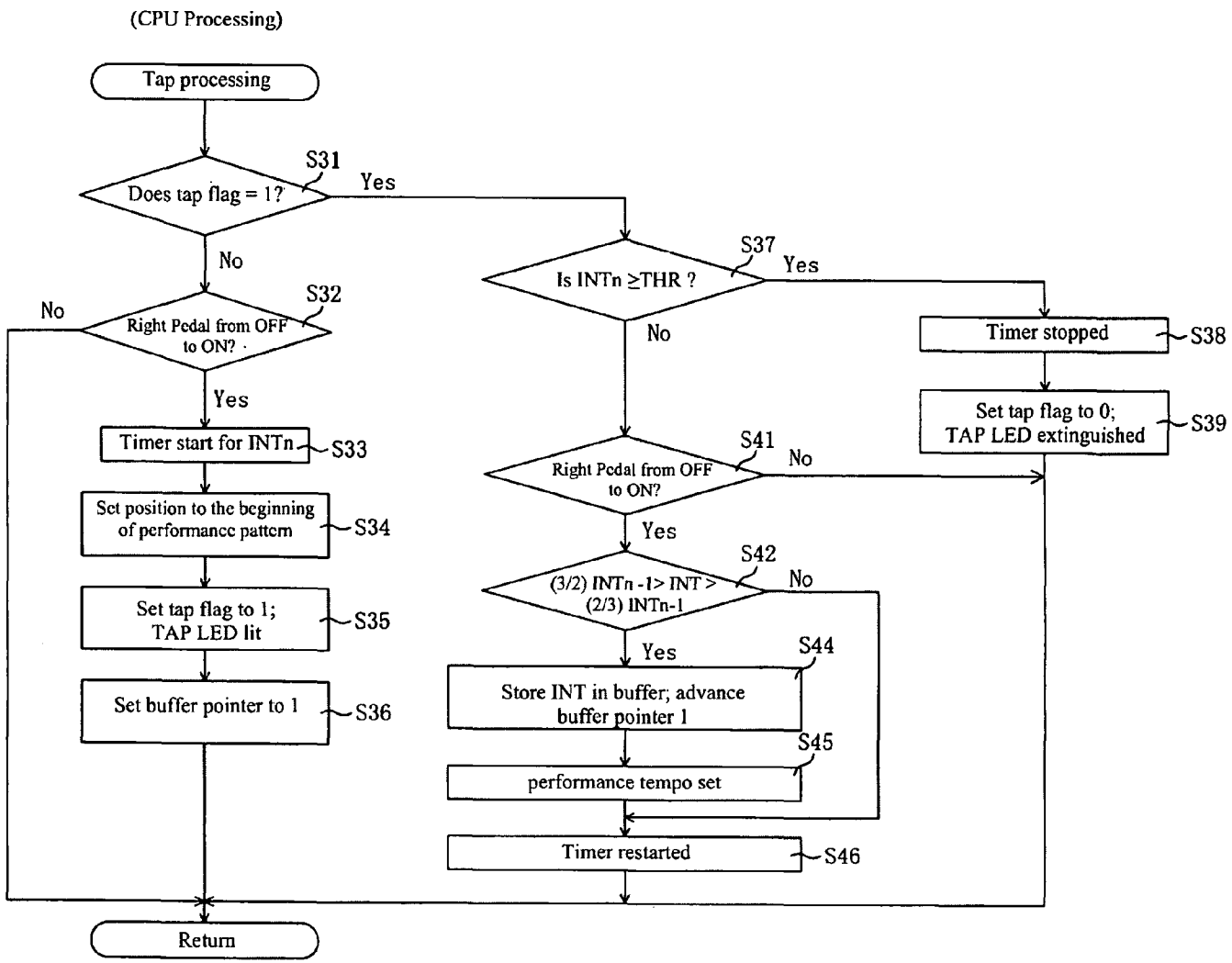
FIG. 7 is a flowchart illustrating tap processing in accordance with an embodiment of the present invention.

FIG. 7 is a flowchart illustrating tap processing in accordance with an embodiment of the present invention. With reference to FIGS. 1, 2, and 7, first, in step S31, a determination may be made as to whether or not the tap flag has been set to 1. If the tap flag has not been set to 1 (S31: no), the tap input standby state may be set and, next in step S32, a determination may be made as to whether or not the right pedal switch RP has been operated from Off to On. If the right pedal switch RP has been operated from Off to On (S32: yes), calculation of a time INTn may be started by the timer 11*a* (step S33). Next in step S34, the pointer indicating a current position of the performance pattern may be shifted to the beginning of the performance pattern. Then in step S35, the tap flag may be set to 1 and the tap LED 62 may be lit. Next in step S36, the pointer of the tap buffer 12*a* may be set to 1, which may be the initial address.

On the other hand, if during step S31, the tap flag is 1 (S31: yes) (i.e., the tap input standby state is not set), a determination may be made as to whether or not the time INTn calculated by the timer 11*a* has reached a threshold value THR (step S37). The threshold value THR may be a value set approximately based on a minimum value of the performance tempo. For example, a performance tempo value of 30 BPM has a time interval of two seconds per beat. Therefore, the threshold value THR may be set to 2 or more seconds, for example 2.5 seconds.

If the time INTn calculated by the timer 11*a* equals or surpasses the threshold value THR (S37: yes), the timer 11*a* may be stopped (step S38). Next in step S39, the tap flag may be set to 0 and the tap input standby state may be set, accordingly, the LED 62 may be extinguished.

If the time INTn calculated by the timer 11*a* does not equal or surpass the threshold value THR (S37: no), a determination may be made as to whether or not the right pedal switch RP has been operated from Off to On (step S41). In some embodiments, the threshold value for step S37 need not necessarily have to equal the threshold value THR; the threshold value for step S37 can be, for example, less than the threshold value THR. If the right pedal switch RP has been operated from Off to On (S41: yes), a determination may be made as to whether or not the time INTn calculated by the timer 11*a* is within a particular range, for example a range from 2/3 to 3/2 of a previously calculated time INTn-1 (step S42).

If the right pedal switch RP has been operated from Off to On for a second time from the tap input standby state, the previously calculated time may correspond to a value of the performance tempo in the tap input standby state. If the time INTn is within the range from (2/3) INTn-1 to (3/2) INTn-1 (S42: yes), the time INTn may be stored at the location indicated by the pointer of the tap buffer 12*c* and the pointer may advance 1 (step S44). As discussed previously, in some embodiments, eight (or any number) instances of times INTn-7 through INTn may be stored. When a new time INTn is to be stored, the new time INTn may replace an oldest stored time INTn-7.

Next in step S45, an average value of the eight instances of the times INTn-7 through INTn stored in the tap buffer 12*c* may be derived. The time interval of the tick may be computed from the average value, and the timer 11*a* may be set such that a timer interrupt is generated at the tick time. Accordingly, the performance tempo may be changed with the tap operation.

In a case where the time INTn is not within the range (S42: no), or in a case where step S45 has been performed, the time INTn calculation by the timer 11*a* may be restarted to 0 (step S46). As such, a time INTn outside the range (e.g., a time INTn derived from an erroneous operation or otherwise a large change in performance tempo) may be disregarded.

If, during step S32, the right pedal switch RP has not been operated from Off to On (S32: no), or if, during step S42, the right pedal switch RP has not been operated from Off to On (S41: no), or if step S36, S39, or S46 have been completed, the routine may return to the main processing (FIG. 6).

As discussed above, in some embodiments, only if the right pedal switch RP, which is the tap pedal, has been operated from Off to On in the tap input standby state, may the position of the performance pattern be reset to the beginning of the performance pattern. Accordingly, when the right pedal switch RP is operated from Off to On after that, the performance tempo value may be changed without carrying out a change in position of the performance pattern. As a result, it may be possible to prevent an unnatural performance caused by changing the position of the performance for each tap operation from Off to On. As such, it may be possible, for example, to cue the effect performance pattern and the like at any desired timing.

For example, in a case where a performance pattern is produced along with a band performance, and a timing of the playback of the performance pattern (e.g., a repeated performance) has deviated from the band performance, the effect device 1 may allow for the timing of the performance pattern to conform to the performance sequence of the band with an easy operation, for example, simply by stepping on the tap pedal at a suitable break point in the music of the band performance (e.g., at an end point of the introduction, or at the first beat of the starting bar of the melody).

Figure 8:
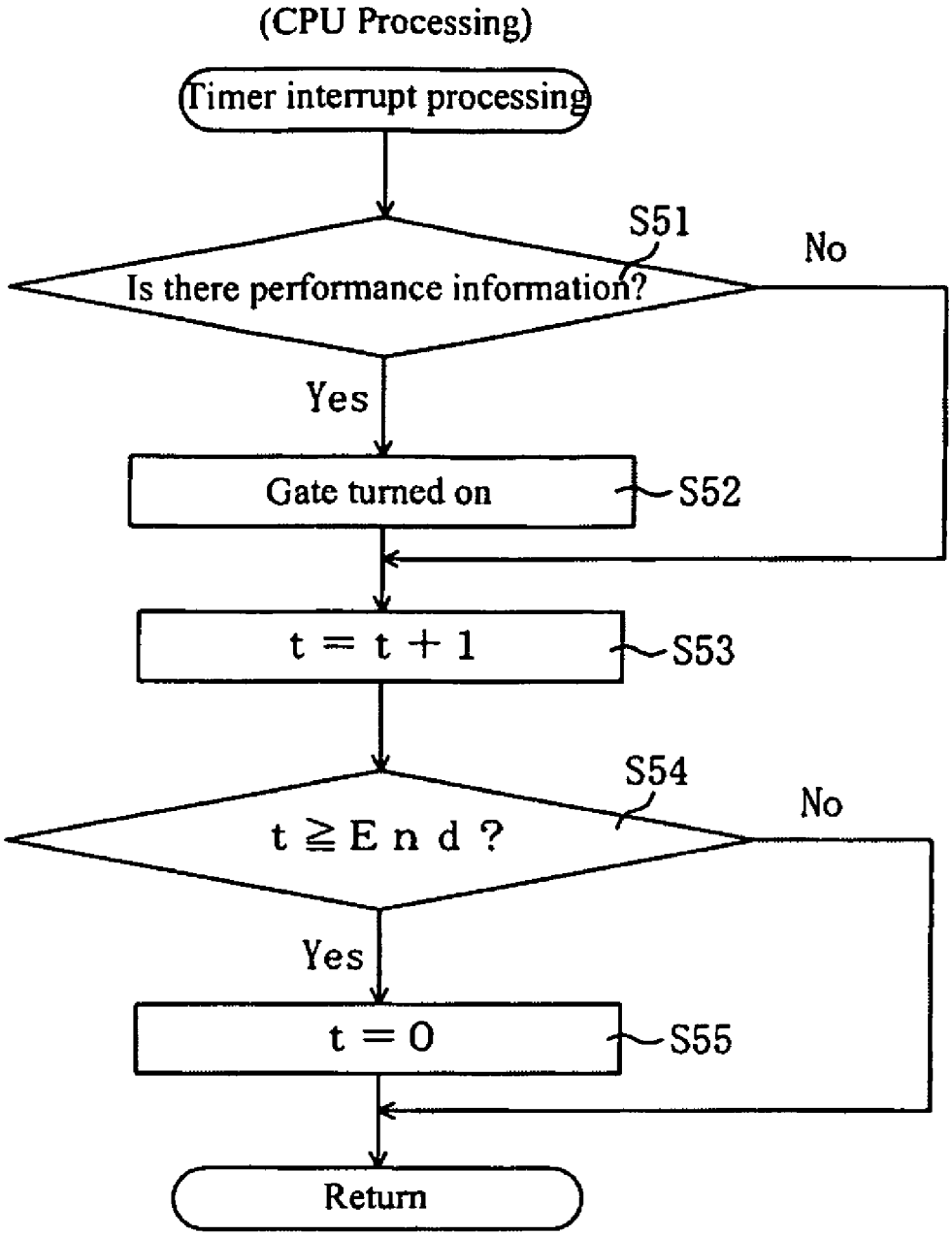
FIG. 8 is a flowchart illustrating timer interrupt processing in accordance with an embodiment of the present invention.

FIG. 8 is a flowchart illustrating timer interrupt processing in accordance with an embodiment of the present invention. With reference to FIGS. 1, 2, and 8, the timer interrupt processing is processing that may be launched at each tick time (refer to FIGS. 5(*a*) and 5(*b*)) based on a value of the performance tempo.

First, in step S51, a determination may be made as to whether or not performance or control information exists for a current time t of the performance pattern (e.g., a performance pattern that is directed by the bank knob 5 and the pattern knob 6) being performed. The current time t may correspond to a tick time (refer to FIGS. 5(*a*) and 5(*b*)). If the performance information exists (S51: yes), an instruction may be issued that turns on the gate section 32 (FIG. 3) corresponding to the string indicated by the performance information for the amount of time set by the duty knob 8 (step S52). Examples of performance patterns containing performance information are shown in FIGS. 5(*a*) and 5(*b*).

Returning to FIGS. 1, 2, and 8. If the performance information does not exist at the current time (S51: no), or if step S52 has been performed, the current time t may be advanced by 1 (step S53). Next, in step S53, a determination may be made as to whether or not the current time t has reached time End, which is the termination of the performance pattern (step S54). If the current time t has reached the time End (S54: yes), the current time t may be set to 0 (step S55). If the current time t has not reached the time End (S54: no), or if step S55 has been performed, the timer interrupt processing may end. For example, the value of the time End in FIG. 5 is 96 (i.e., 96 ticks). However, the time End may be set to any amount of time.

With reference to FIGS. 1-8, as discussed, in some embodiments, the effect device 1 may be configured to change a performance position and a performance tempo by operating an operator, such as the right pedal switch RP. In a case where the right pedal switch RP is not operated On (i.e., the right pedal switch RP remains in the Off state) for a specified time or more, the tap input standby state may be set. When the right pedal switch RP is operated from Off to On in the tap input standby state, the performance position may be set to the beginning of the performance pattern. On successive tapping operations of the right pedal switch RP, the performance tempo may be set with the time interval of the On from the Off operation of the right pedal switch RP.

Thus in such embodiments, the performance position may change only in a case where the right pedal switch RP is operated from Off to On in the tap input standby state. The performance position may remain unchanged by subsequent tapping operations of the right pedal switch RP. As a result, a more natural performance may be carried out without stopping or stepping forward the performance.

In some embodiments, when the right pedal switch RP is operated from Off to On in the tap input standby state, the performance position may be set to the beginning of the performance pattern (i.e., the first (down) beat). In other embodiments, the performance position may be set to any suitable or otherwise desired position, for example a second beat, a third beat, or the like. Moreover, the user may be able to set the performance position to any desired optional position such as the first (down) beat, the second beat, the third beat, or the like.

In some embodiments, the tap operation discussed above may be for use with an effect device, such as an effect device for applying a slice effect. In other embodiments, the tap operation discussed above may be for use with various types of musical instruments and devices. Such devices may include an automatic performance device for carrying out an automatic performance based on performance data, a rhythm performance device for carrying out an automatic performance of a rhythm pattern, a waveform reproduction device (i.e., a sampler) for reproducing and storing a sampled waveform, or the like.

In some embodiments, there may be a plurality ways to calculate time for setting the performance tempo resulting from the tap operations. For instance, the average value for the tempo may be computed. Accordingly, the performance tempo may be set based on the average value. In other embodiments, a weighted average value may be applied. For example, a most recently derived time period may be weighted greater than a time period derived before that. In other embodiments, the average value may be computed only with time intervals of specific beats. For example, an average may be calculated that only includes the time intervals of the first beat and the third beat, while the time intervals of the second beat and the fourth beat may be ignored.

In some embodiments, a performance pattern of a specified performance length is performed repeatedly. In other embodiments, the performance pattern may be terminated once the performance of the performance pattern has finished (i.e., the performance pattern is not repeated).

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A performance device, the performance device comprising:

an operator adapted to be operated by a performer;

a time calculation means for calculating a time period between a timing when the operator is operated and a previous timing when the operator was previously operated;

a determination means for determining whether the time period equals or exceeds a specified time period;

a tempo setting means for setting a performance tempo;

a storage means for storing performance data;

a performance means for reading the performance data stored on the storage means to carry out a performance based on the performance tempo set by the tempo setting means;

a performance position changing means for changing a performance position of the performance carried out by the performance means to a specified performance position when the operator is operated and the determination means determines that the time period equals or exceeds the specified time period; and a tempo changing means for changing the performance tempo based on the time period calculated by the time calculation means when the operator is operated and the determination means determines that the time period does not equal or exceed the specified time period.

2. The performance device of claim 1, the performance data stored on the storage means having a specified length;

the performance means configured to carry out the performance by repeatedly reading the performance data stored on the storage means; and the performance position changing means configured to change the performance position to a beginning point of the performance data.

3. The performance device of claim 2, the tempo changing means comprising:

a tempo fluctuation suppression means for suppressing a fluctuation of the performance tempo.

4. The performance device of claim 3, the performance device further comprising:

a display means for displaying an indicator for indicating that a tap input standby state is set;

the performance position changing means configured to change the performance position of the performance performed by the performing means to the specified performance position in a case where the indicator indicates that the tap input standby state is set and the operator is operated in the tap input standby state.

5. The performance device of claim 2, the performance device further comprising:

a display means for displaying an indicator for indicating that a tap input standby state is set;

the performance position changing means configured to change the performance position of the performance performed by the performing means to the specified performance position in a case where the operator is operated in the tap input standby state and the indicator indicates that the tap input standby state is set.

6. The performance device of claim 1, the tempo changing means comprising:

a tempo fluctuation suppression means for suppressing a fluctuation of the performance tempo.

7. The performance device of claim 6, the performance device further comprising:

a display means for displaying an indicator for indicating that a tap input standby state is set;

the performance position changing means configured to change the performance position of the performance performed by the performing means to the specified performance position in a case where the operator is operated in the tap input standby state and the indicator indicates that the tap input standby state is set.

8. The performance device of claim 1, the performance device further comprising:

a display means for displaying an indicator for indicating that a tap input standby state is set;

the performance position changing means configured to change the performance position of the performance performed by the performing means to the specified performance position in a case where the operator is operated in the tap input standby state and the indicator indicates that the tap input standby state is set.

9. The performance device of claim 1, wherein the specified time period has a value greater than zero.

10. The performance device of claim 9, wherein the value of the specified time period is greater than 2 seconds.

11. The performance device of claim 9, wherein the value of the specified time period has a value greater than a time interval between beats of the performance tempo.

12. The performance device of claim 1, wherein time period corresponds to an amount of time since the operator has been operated.

13. The performance device of claim. 1, wherein the operator comprises a pedal switch.

14. The performance device of claim 2, the performance position changing means configured to change the performance position to the beginning point of the performance data when the operator is operated and the determination means determines that the time period equals or exceeds the specified time period.

15. The performance device of claim 14, the performance position changing means configured not to change the performance position when the operator is operated and the determination means determines that the time period does not equal or exceed the specified time period.

16. A performance device for adjusting a musical performance, the performance device comprising:

an operator adapted to be operated by a user;

a timer for timing a current time period corresponding to an amount of time since a previous operation of the operator;

a control for setting a tempo; and circuitry for processing data to carry out a performance based on the tempo;

the circuitry configured to determine whether the current time period equals or exceeds a specified time period;

the circuitry configured to change a position of the performance to a specified position of the performance when the operator is operated and the circuitry determines that the current time period equals or exceeds the specified time period; and the circuitry configured to change the tempo based on the current time period when the operator is operated and the circuitry determines that the current time period does not equal or exceed the specified time period.

17. The performance device of claim 16, the performance device further comprising:

a storage device for storing the data processed by the circuitry.

18. The performance device of claim 16, the data comprising performance information; and the circuitry configured to process the performance information repeatedly.

19. The performance device of claim 16, the data comprising performance information; and the circuitry configured to change a position of the performance to a beginning position of the performance information in a case where the operator is operated and the current time period equals or exceeds a specified time period.

20. The performance device of claim 16, the circuitry configured to set a first state in a case where the operator is operated and the current time period equals or exceeds a specified time period; and the circuitry configured to set a second state in a case where the operator is operated and the current time period is less than the specified time period.

21. The performance device of claim 20, the performance device further comprising:

a display device for indicating that at least one of the first state and the second state is set.

22. The performance device of claim 21, the circuitry configured to change a position of the performance to a specified position of the performance in a case where (i) the operator is operated, (ii) the display device indicates that the first state is set, and (iii) the operator is operated in the first state.

23. The performance device of claim 16, the circuitry configured to change the tempo based on the current time period in a case where the current time period is less than the specified time period and a time period of a subsequent operation of the operator is within a specified range of the current time period.

24. The performance device of claim 23, wherein the specified range is approximately between two-thirds of the current time period and three-halves of the current time period.

25. The performance device of claim 23, wherein the tempo is set based on an average of the current time period and the time periods of the subsequent operation.

26. A method of adjusting a musical performance, the method comprising:

calculating a current time period between a timing where an operator is operated and a previous timing where the operator was previously operated;

setting a tempo;

carrying out a performance based on the tempo;

determining whether the current time period equals or exceeds a specified time period;

changing a position of the performance to a specified position of the performance when the operator is operated and the circuitry determines that the current time period equals or exceeds the specified time period; and changing the tempo based on the current time period when the operator is operated and the circuitry determines that the current time period does not equal or exceed the specified time period.

* * * * *